US010553982B2

(12) United States Patent
Sha et al.

(10) Patent No.: US 10,553,982 B2
(45) Date of Patent: Feb. 4, 2020

(54) ELECTRICAL CONNECTOR

(71) Applicant: FOXCONN INTERCONNECT TECHNOLOGY LIMITED, Grand Cayman (KY)

(72) Inventors: Lu-Lu Sha, Kunshan (CN); Guo-Hua Zhang, Kunshan (CN); Li-Jiang Wang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/015,142

(22) Filed: Jun. 21, 2018

(65) Prior Publication Data

US 2018/0375248 A1 Dec. 27, 2018

(30) Foreign Application Priority Data

Jun. 21, 2017 (CN) ..... 2017 2 0723431 U

(51) Int. Cl.

| | |
|---|---|
| ***H01R 24/60*** | (2011.01) |
| ***H01R 13/516*** | (2006.01) |
| ***H01R 29/00*** | (2006.01) |
| ***H01R 13/502*** | (2006.01) |
| ***H01R 13/703*** | (2006.01) |

(Continued)

(52) U.S. Cl.

CPC ..... *H01R 13/516* (2013.01); *H01R 12/707* (2013.01); *H01R 12/724* (2013.01); *H01R 13/502* (2013.01); *H01R 13/703* (2013.01); *H01R 29/00* (2013.01); *H01R 24/60* (2013.01); *H01R 2107/00* (2013.01)

(58) Field of Classification Search

CPC .... H01R 13/516; H01R 4/028; H01R 12/716; H01R 13/41; H01R 13/703; H01R 12/707; H01R 29/00; H01R 12/724; H01R 13/502; H01R 43/0256; H01R 2107/00; H01R 24/60

See application file for complete search history.

(56) References Cited

U.S. PATENT DOCUMENTS 6,491,536 B1 * 12/2002 Torii ..... H01R 12/716 439/246
8,002,589 B1 * 8/2011 Yu ..... H01R 13/6485 439/660

(Continued)

FOREIGN PATENT DOCUMENTS

CN 103427236 A 12/2013

*Primary Examiner* — Truc T Nguyen

(74) *Attorney, Agent, or Firm* — Wei Te Chung; Ming Chieh Chang

(57) ABSTRACT

An electrical connector includes an insulative housing and a number of terminals retained in the insulative housing. The insulative housing has a mating surface, a mounting surface, and a slot going through the mounting surface. The terminal received in the slot includes an interference portion retained in the slot, a contacting portion disposed around the mating surface, and a soldering leg extending downwardly beyond the mounting surface. The interference portion has two barbs disposed at two opposite sides thereof, respectively. The terminal includes a blocking portion connecting between the interference portion and the soldering leg. The width of the blocking portion is greater than the width of the interference portion.

17 Claims, 7 Drawing Sheets

(51) Int. Cl.

| | |
|---|---|
| ***H01R 12/70*** | (2011.01) |
| ***H01R 12/72*** | (2011.01) |
| *H01R 107/00* | (2006.01) |

(56) References Cited

U.S. PATENT DOCUMENTS

| | | | | |
|---|---|---|---|---|
| 8,147,277 | B1 * | 4/2012 | Wang | H01R 24/62 439/541.5 |
| 8,262,420 | B2 * | 9/2012 | Xiong | H01R 13/6582 439/701 |
| 8,439,691 | B1 * | 5/2013 | Lan | H01R 12/724 439/660 |
| 8,641,454 | B2 * | 2/2014 | Chen | H01R 13/6594 439/660 |
| 9,425,558 | B1 * | 8/2016 | Hsu | H01R 12/724 |
| 2007/0269996 | A1 * | 11/2007 | Chia | H01R 13/6471 439/66 |
| 2017/0346232 | A1 * | 11/2017 | Zhao | H01R 24/60 |

* cited by examiner

ELECTRICAL CONNECTOR

BACKGROUND OF THE INVENTION

1. Field of the Invention

The present invention relates to an electrical connector, and particularly to an electrical connector having terminals inserted into an insulative housing.

2. Description of Related Art

An existing electrical connector includes an insulative housing, a plurality of terminals inserted into the insulative housing, and a metal shell surrounding around the insulative housing. The electrical connector defines a plurality of slots to receive the terminals, respectively. The terminal includes an interference portion retained in the corresponding slot, a contacting portion extending from one end of the interference portion, and a soldering leg extending from the other end of the interference portion. During the welding process, the soldering flux can easily climb into the slots from the soldering legs.

Therefore, it is desired to provide a new electrical connector.

SUMMARY OF THE INVENTION

To achieve the above desire, the present invention provides an electrical connector comprising an insulative housing and a plurality of terminals retained to the insulative housing. The insulative housing has a mating surface, a mounting surface, and a slot going through the mounting surface. The terminal received in the slot includes an interference portion retained in the slot, a contacting portion disposed around the mating surface, and a soldering leg extending downwardly beyond the mounting surface. The interference portion has two barbs disposed at two opposite sides thereof, respectively. The terminal includes a blocking portion connecting between the interference portion and the soldering leg. The width of the blocking portion is greater than the width of the interference portion.

DETAILED DESCRIPTION OF THE PREFERRED EMBODIMENT

Figure 1:
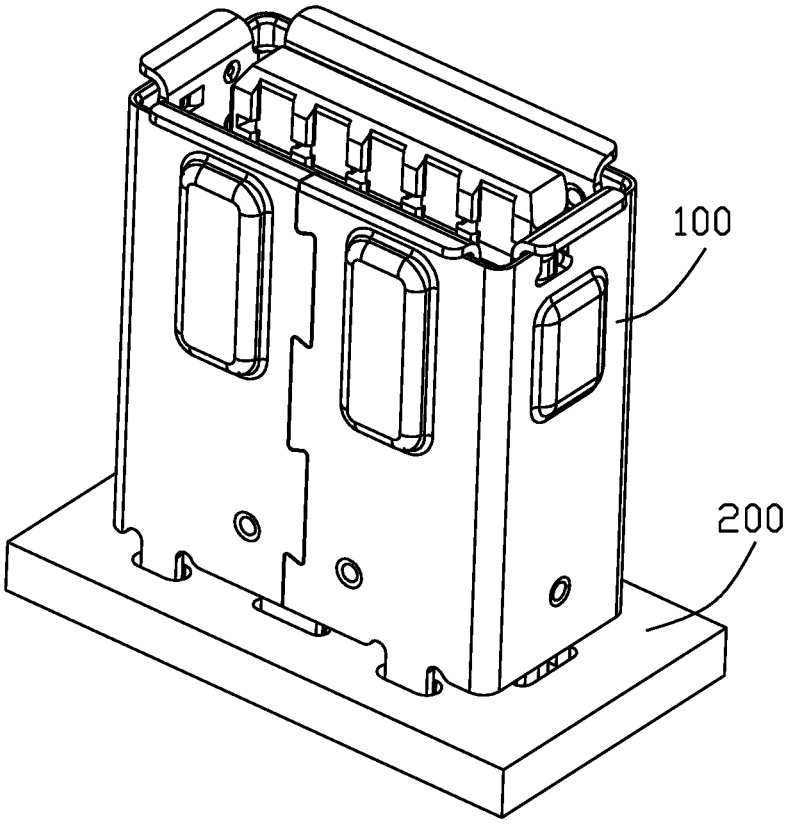
FIG. 1 is a perspective view of an electrical connector soldered to a circuit board according to the invention.
Figure 2:
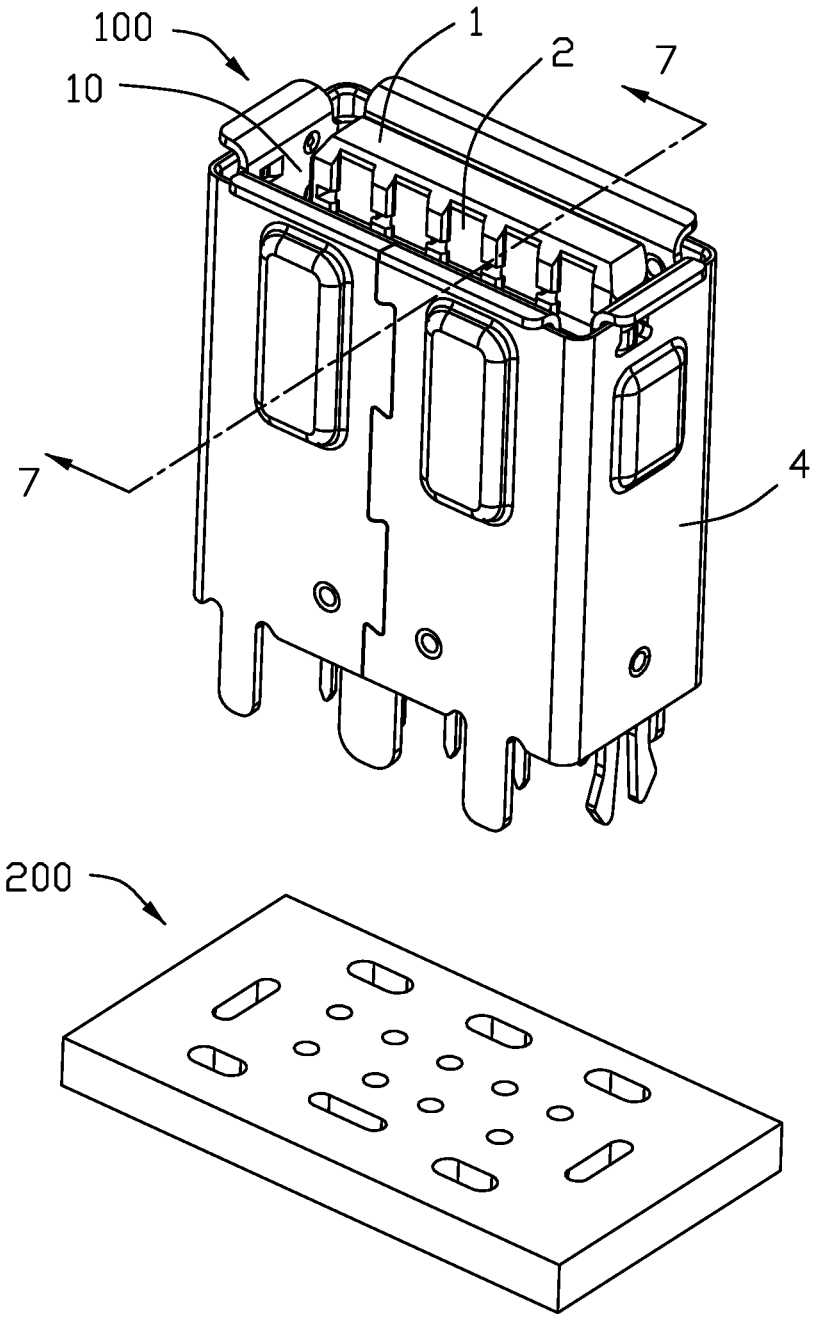
FIG. 2 is a perspective view of the electrical connector of FIG. 1, showing the electrical connector and the circuit board separated from each other.
Figure 3:
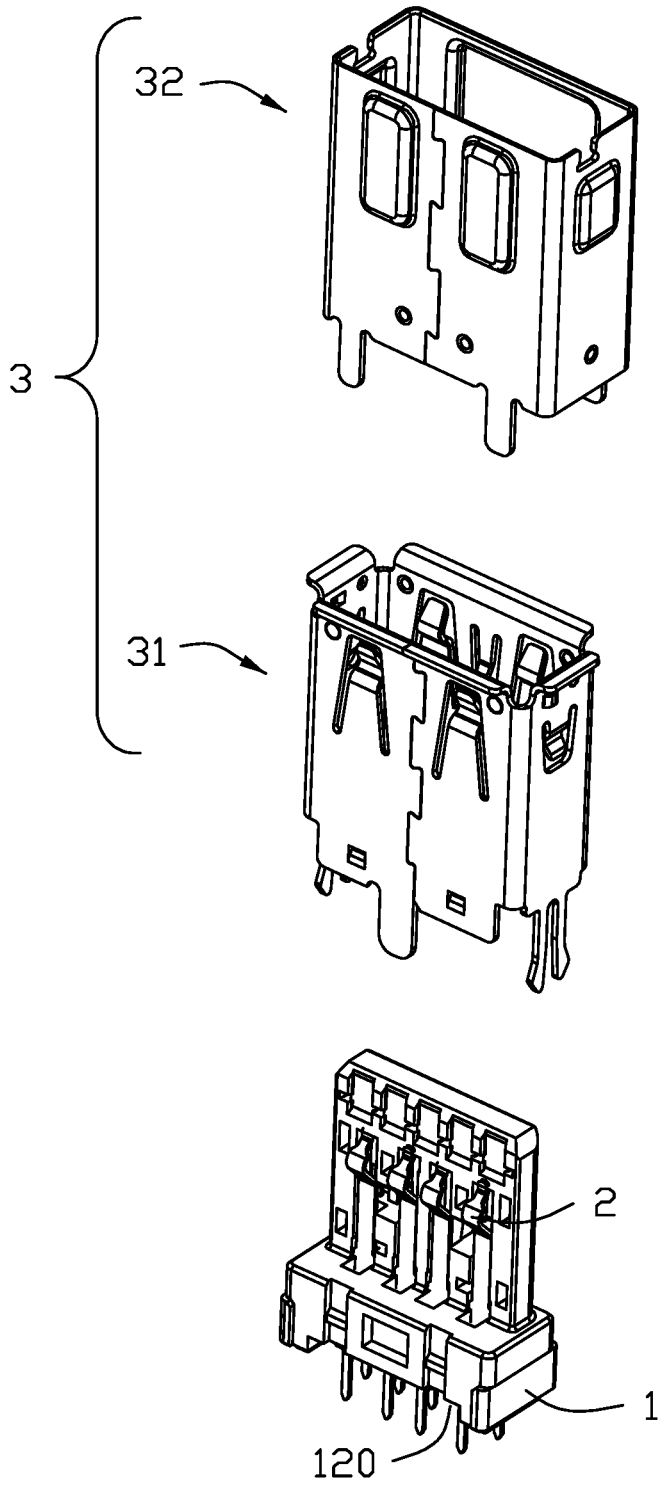
FIG. 3 is an exploded view of the electrical connector of FIG. 1.
Figure 4:
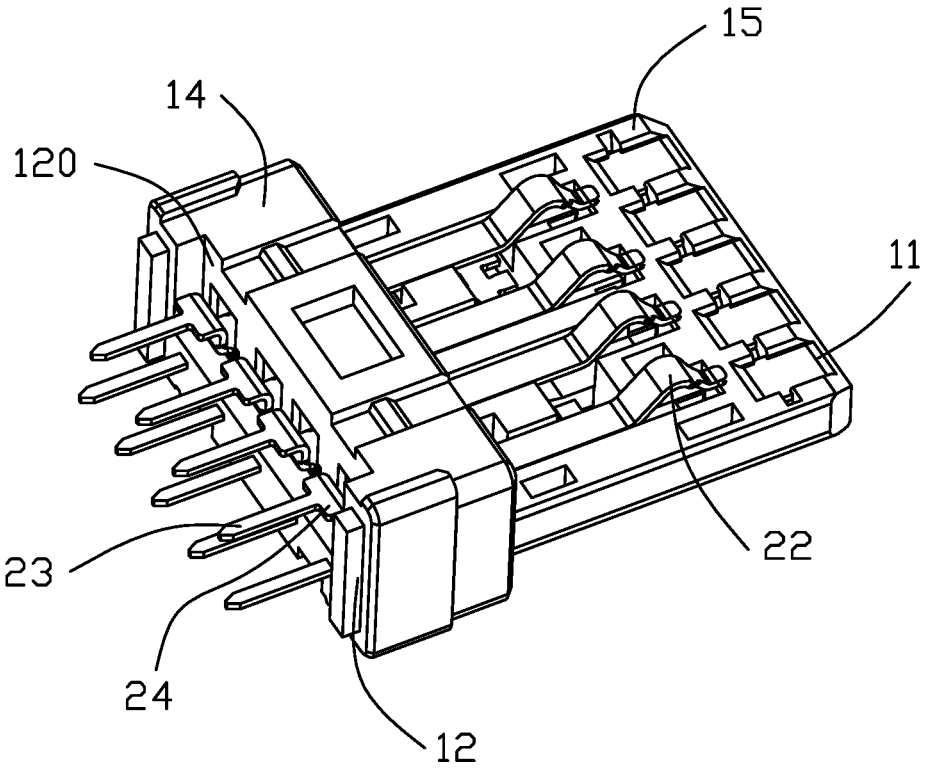
FIG. 4 is another perspective view of the electrical connector omitted the metal shell of FIG. 3.

Referring to FIGS. 1-2, an electrical connector 100 soldered to a circuit board 200 includes an insulative housing 1, a plurality of terminals 2 retained to the insulative housing 1, and a metal shell 3 surrounding around the insulative housing 1. The metal shell 3 surrounds around the insulative housing 1 to form a mating chamber 10. In this embodiment, the electrical connector 100 is vertically mounted on the circuit board 200. When the circuit board 200 is placed horizontally, the chamber 10 is opening upwardly.

Referring to FIGS. 3 to 7, the insulative housing 1 has a mating surface 11, a mounting surface 12, and a set of slot or a plurality of contact receiving passageways 13 going through the mounting surface 12 to receive the terminals 2. The insulative housing 1 includes a base portion 14 and a mating portion 15 extending therefrom. The base portion 14 includes the mounting surface 12. The slot 13 goes through the base portion 14 to the mating portion 15. The mating portion 15 has two surfaces disposed oppositely, and the terminals 2 are disposed at one of the surfaces. A receiving groove 120 is inwardly recessed from a side of the base portion 14. A supporting block 121 protrudes downwardly from the mounting surface 12. The supporting block 121 is supported by the circuit board 200.

Each of the terminals 2 has an interference portion 20 retained in the slot 13, a deflectable curved contacting portion 22 disposed around the mating surface 11, and a soldering leg 23 extending downwardly beyond the mounting surface 12. The interference portion 20 has two barbs 21 disposed at two opposite sides thereof, respectively. The slot 13 includes a pair of interference grooves 131 recessed along two opposite direction and a mounting groove 132 communicating with the interference groove 131. The width of the interference groove 131 is greater than the width of the mounting groove 132. The barbs 21 interfere with the interference grooves 131. The contacting portion 22 is exposed to one surface of the mating portion 15.

The terminal 2 includes a blocking portion 24 connecting between the interference portion 20 and the soldering leg 23. The width of the blocking portion 24 is greater than the width of the interference portion 20. Notably, there is a neck section 25 between the blocking portion 24 and the soldering leg 23. The blocking portion 24 extends out of the slot 13. In the welding process, the blocking portion 24 can prevent the soldering flux from creeping into the slot 13.

Figure 5:
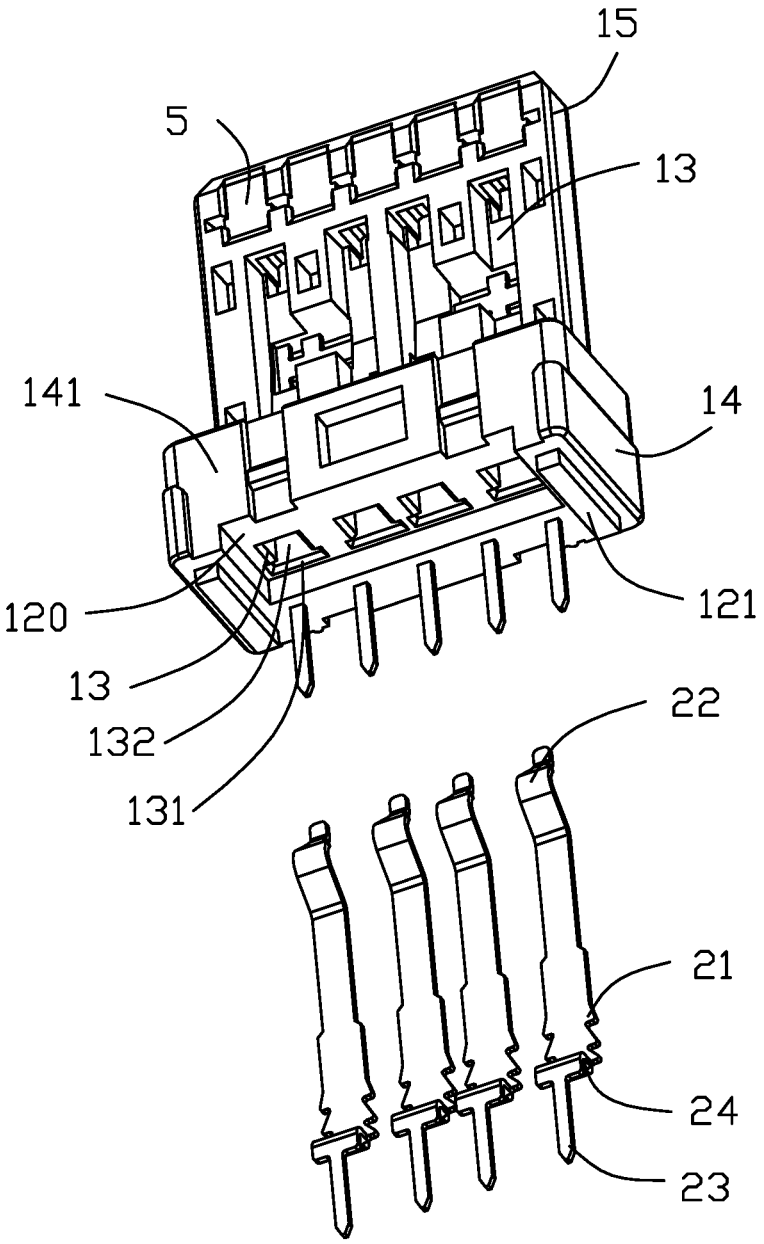
FIG. 5 is a further exploded view of FIG. 4.
Figure 6:
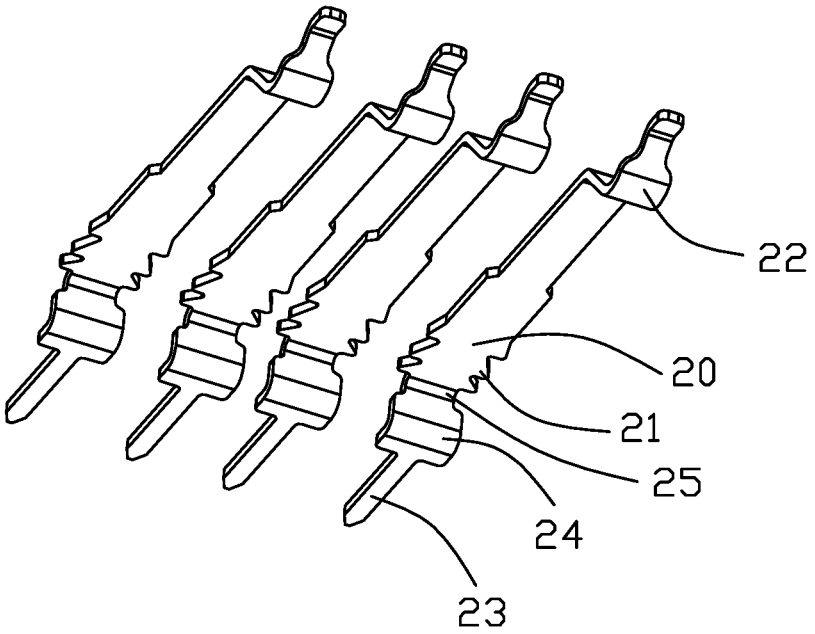
FIG. 6 is a perspective view of the terminals of FIG. 5.
Figure 7:
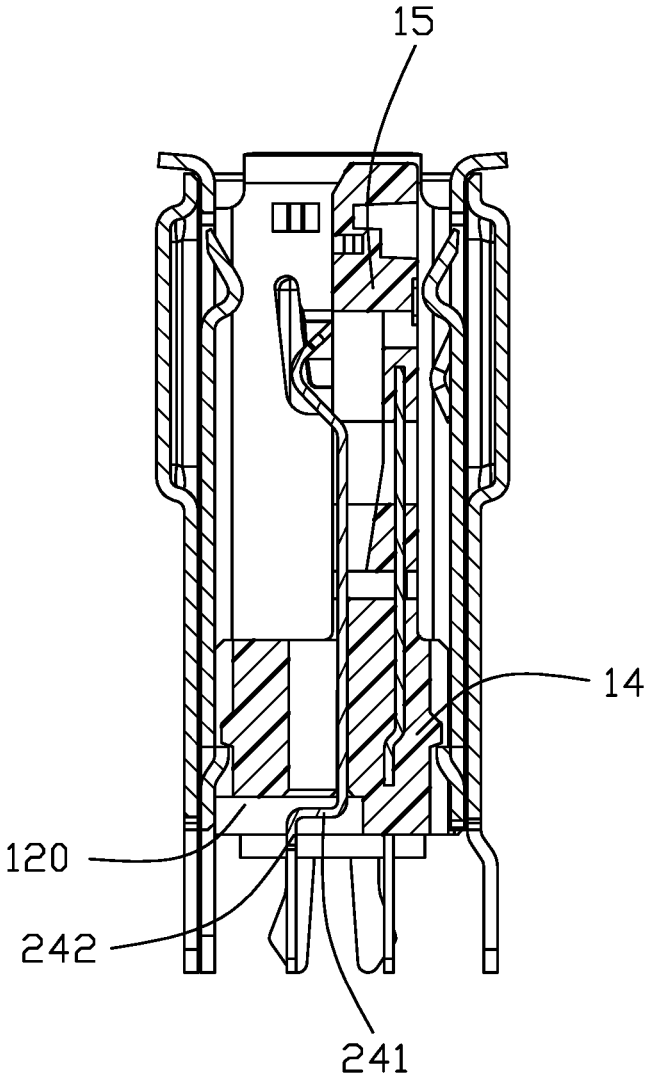
FIG. 7 is a cross-sectional view of the electrical connector taken along line 7-7 in FIG. 2.

Referring to FIGS. 5 and 6, the width or dimension of the blocking portion 24 is greater than the width of the slots 23 for covering the slot 23. The interference portion 20 is greater than the width of the slot 23. The terminal 2 is bent at the blocking portion 24. The soldering leg 23 extends straightly from one end of the blocking portion 24, and the interference portion 20 extends from the other end of the blocking portion 24. The terminals 2 can be easily assembled in the insulative housing 1. In this embodiment, the blocking portion 24 is L-shaped and has a horizontal surface 241 and a vertical surface 242. The interference portion 20 is perpendicular to the horizontal surface 241. Therefore, the interference portion 20 is parallel to the soldering leg 23. The blocking portion 24 is disposed in the receiving groove 120 so that the electrical connector 100 is conveniently soldered to the circuit board 200. In this embodiment, the receiving groove 120 also goes through a side surface 141 of the base portion 14. The blocking portion 24 is exposed to the receiving groove 120. During the soldering process, the soldering flux can be observed to climb upwardly at any time.

In the present invention, the electrical connector 100 is a vertical USB 3.1 type-A connector. Each of the terminals 2 is a USB 2.0 terminal. The width of the interference portion 20 is 1.0 mm. The width of the blocking portion 24 is 1.4 mm. The electrical connector 100 also has a USB 3.1 terminal 5 retained to the insulative housing 1 by injection molding so that the soldering flux can't climb upwardly into the insulative housing 1 where the USB 3.1 terminal retained thereto. It is noted that the present invention is not limited to the application of the USB 3.1 connector. Notably, The blocking portion has a lower end section (not) labeled) coplanar with the soldering leg in the vertical direction, which may reinforce the blocking portion. Also, the mounting surface 12 includes a pair of standoffs 121 which is longer/higher than that lower end section so that such a lower end section of the blocking porting will not affect the stability of the housing which is seated upon the printed circuit board on the pair of standoffs.

However, the disclosure is illustrative only, changes may be made in detail, especially in matter of shape, size, and arrangement of sections within the principles of the invention.

What is claimed is:

1. An electrical connector comprising:

an insulative housing having a mating surface, a mounting surface, and a slot going through the mounting surface; and a plurality of terminals retained to the insulative housing and received in the slot, the terminal including an interference portion retained in the slot, a contacting portion disposed around the mating surface, and a soldering leg extending beyond the mounting surface, the interference portion having a pair of barbs disposed at two opposite sides, respectively; wherein the terminal includes a blocking portion connecting with the soldering leg, and a neck section connecting with the interference portion, the blocking portion is connecting with the neck portion, and the width of the blocking portion is greater than the width of the interference portion and the width of the neck section; wherein the width of the interference portion is 1.0 mm, and the width of the blocking portion is 1.4 mm.

2. The electrical connector as claimed in claim 1, wherein the width of the blocking portion is greater than the width of the soldering leg, and the width of the interference portion is greater than the width of the soldering leg.

3. The electrical connector as claimed in claim 2, wherein the terminal is bent at the blocking portion, the soldering leg extends from one end of the blocking portion, and the interference portion extends from the other end of the blocking portion.

4. The electrical connector as claimed in claim 1, wherein the blocking portion extends out of the slot.

5. The electrical connector as claimed in claim 1, wherein the slot includes a pair of interference grooves recessed along two opposite direction, and the barbs interfere with the interference grooves.

6. The electrical connector as claimed in claim 5, wherein the slot includes a mounting groove communicating with the interference groove, and the width of the interference groove is greater than the width of the mounting groove.

7. The electrical connector as claimed in claim 1, wherein the insulative housing defines a receiving groove inwardly recessed from the mounting surface, and the blocking portion is disposed in the receiving groove.

8. The electrical connector as claimed in claim 7, wherein the insulative housing includes a base portion and a mating portion extending from the base portion, the base portion is provided with the mounting surface, and the receiving groove also goes through a side surface of the base portion.

9. The electrical connector as claimed in claim 1, wherein the electrical connector is a vertical USB 3.1 type-A connector and the terminal is a USB 2.0 terminal.

10. An electrical connector comprising:

an insulative housing having a mating side and a mounting side opposite to each other in a vertical direction, a mounting surface formed on the mounting side, and a plurality of contact receiving passageways going through the mounting surface in the vertical direction; and a plurality of terminals retained to the insulative housing and received in the corresponding contact receiving passageways, respectively, the terminal including a deflectable curved contacting portion disposed around the mating side, and a soldering leg extending downwardly beyond the mounting surface, and an interference portion located between the soldering leg and the contacting portion and secured to the housing in an interference fit; wherein the terminal further includes a blocking portion located between the interference portion and the soldering leg and extending in a transverse direction perpendicular to said vertical direction, and a dimension of the blocking portion is not less than a cross-section of the contact receiving passageway to fully cover the contact receiving passageway in a bottom view along the vertical direction.

11. The electrical connector as claimed in claim 10, wherein a width dimension of the blocking portion is larger than that of he interference portion in a longitudinal direction perpendicular to both said vertical direction and said transverse direction.

12. The electrical connector as claimed in claim 10, wherein said blocking portion is located outside of the corresponding contact receiving passageway.

13. The electrical connector as claimed in claim 10, wherein a neck section is formed between the blocking portion and the interference portion.

14. The electrical connector as claimed in claim 10, wherein the blocking portion has a bottom region coplanar with the corresponding soldering leg in the vertical direction.

15. The electrical connector as claimed in claim 14, wherein the housing includes a standoff on the mounting surface, and the bottom region of the blocking portion is shorter than the standoff in the vertical direction.

16. The electrical connector as claimed in claim 13, wherein a width of the neck section is smaller than both those of the blocking portion and the interference portion.

17. An electrical connector comprising:

an insulative housing having a mating surface, a mounting surface, and a slot going through the mounting surface ;and a plurality of terminals retained to the insulative housing and received in the slot, the terminal including an interference portion retained in the slot, a contacting portion disposed around the mating surface, and a soldering leg extending beyond the mounting surface, the interference portion having a pair of barbs disposed at two opposite sides, respectively; wherein the terminal includes a blocking portion connecting between the interference portion and the soldering leg, and the width of the blocking portion is greater than the width of the interference portion; wherein the width of the interference portion is 1.0 mm, and the width of the blocking portion is 1.4 mm.

* * * * *